US005094054A

United States Patent [19]

Arends

[11] Patent Number: 5,094,054

[45] Date of Patent: Mar. 10, 1992

[54] METHOD AND APPARATUS FOR VENTING BUILDING STRUCTURES

[76] Inventor: William R. Arends, 3660 Nye St., Carson City, Nev. 89704

[21] Appl. No.: 580,843

[22] Filed: Sep. 11, 1990

[51] Int. Cl.[5] ..... E04D 13/16; E04B 1/74; F24F 7/00

[52] U.S. Cl. ..... 52/302; 52/199; 52/743; 52/95; 454/260

[58] Field of Search ..... 98/29, 32, 37; 52/302, 52/303, 92, 94, 95, 199, 743

[56] References Cited

U.S. PATENT DOCUMENTS

| | | | |
|---|---|---|---|
| 2,350,771 | 6/1944 | Klunder | 98/29 |
| 3,192,849 | 7/1965 | Massengale | 98/37 |
| 4,776,262 | 10/1988 | Curran | 98/37 |
| 4,977,714 | 12/1990 | Gregory | 52/307 |

FOREIGN PATENT DOCUMENTS

| | | | |
|---|---|---|---|
| 2145756 | 4/1985 | United Kingdom | 52/199 |

*Primary Examiner*—James L. Ridgill, Jr.
*Attorney, Agent, or Firm*—Herbert C. Schulze

[57] ABSTRACT

A method and apparatus for venting building structures in the roof and floor areas wherein a screened pan construction is secured to the underside of the roof so as to allow the filling of insulation material, and the like, without obstructing the flow of outside air into and out of the attic space between the ceiling and roof; the same screened pan is secured in the area between the subfloor and foundation of the building structure allowing air flow between the outside of the building and the area beneath the floor structure.

9 Claims, 3 Drawing Sheets

34
18
200
A
30
2
36
3
24
2
44
22
38
12
14
32
16
3
11
10

18
40
34
32
36
40
34
30
36
A
18
40
20
38
40
20

20
34
36
40
38
24
40
36
34
20
A
18
12
30
22
32
18

42
42
30
34
32
38
36
20
36
42
34
42
44
18
22
A
18
20

425
434
424
432
436
418
430
420
428
200
450
440
414
416
422
412
410
413
411

430
442
436
434
432
436
434
448
420
446
444
438
448
422
444
446

560
540
536
534

532
534
538
536
542
530
542

530
550
560
558
558
552
542
554
556
538
542
552

METHOD AND APPARATUS FOR VENTING BUILDING STRUCTURES

BACKGROUND OF THE INVENTION

I. Field of the Invention

This invention is in the general field of building construction and is more particularly directed to the providing of vented openings into the attic region and into the basement regions of a building. The invention is even more particularly directed to such a method and apparatus wherein it includes means to be easily placed at various locations along the sides of the building structure during the construction, or renovation, of said building with a minimum installation time and cost while at the same time not obstructing the placement of insulative material throughout the building.

II. Description of the Prior Art

Prior art construction and method for providing vents into buildings, and the like, has curtailed the full coverage placement of insulating material. Usually vents must have an area adjacent to the insulating material that is void of the insulation in order to allow air to circulate into and out of the building areas described above. Prefabricated vents usually only included a screened cover with fasteners applied to the rafters, and the like. This requires much care and labor to be sure that adequate placement of insulation does not block the vent screens from being fully operable. There is nothing known to me which utilizes the principles of this invention.

SUMMARY OF THE INVENTION

In buildings it is necessary to provide vents to the exterior of the building within the area between a building roof and the top of the ceiling of any particular area. These vents are necessary to eliminate the bad effects of stale air accumulating within the area. The same is true of the area beneath the floor of a building but above the foundation, ground, or other building level.

When insulation is placed in the area of a vent, it is necessary to keep the insulation at a distance from the vent, or to erect some type of barrier at a distance from the vent, to prevent the insulation from clogging the vent. This creates considerable problem in that the insulation may move, even through placed at a distance from the vent. Placing insulation at a distance from the vent, or erecting a proper barrier, creates cold spots which considerably adversely affects the energy requirement and the uniformity of temperature within the building.

I have studied this problem at length, I have particularly addressed my efforts so as to eliminate the necessity of cold spots for the reasons above outlined.

I have now conceived and developed a method and apparatus which effectively eliminates this problem. I have provided troughs open at one end and closed at the other end. In depth, such troughs are approximately one-half of the space between the roof underside and the top of the building wall. In the case of the attic, or other space above the ceiling, this trough is installed with the trough edges adjacent the under side of the roof. The bottom of the trough is at a distance from the ceiling.

Thus, a vent area is created. It remains possible to install insulation by blowing it in, or by using preformed sheets of insulation, or the like, without any problem of clogging the vent by the insulation entering the vent area. In fact the insulation can go all the way to the upper wall, or block, as the case may be, between the eaves. Likewise, with the trough reversed, the same system works for insulation and venting beneath floors.

It is an object of this invention to provide a method and apparatus for venting under building roofs or floors while providing proper insulation above the ceiling, without interference of the insulation with the effectivenessess of vents;

Another object of this invention is to provide such a vent system as has been described wherein the same vent arrangement can be used both for attics and the like and under floors and the like;

Another object of this invention is to provide such an arrangement as has been described wherein insulation can be blown or placed in an area right up to the edge of the open space under the eaves or under floors, as the case may be, without any interference with the vent.

The foregoing and other objects and advantages will become apparent to those skilled in the art upon reading the description of a preferred embodiment which follows in conjunction with a review of the appended drawnings.

DESCRIPTION OF A PREFERRED EMBODIMENT

Figure 1:
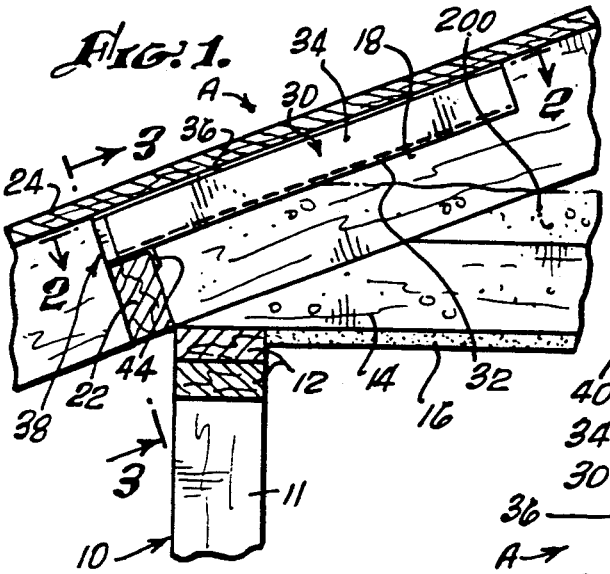
FIG. 1 is a partial, broken away, sectional view through a roof and sidewall of a building, showing a vent structure suitable to practice the method of this invention.
Figure 2:
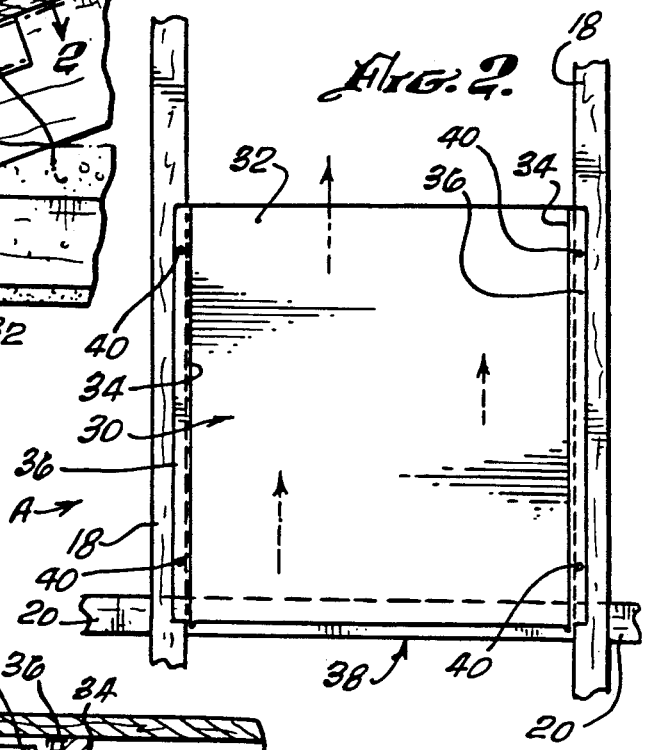
FIG. 2 is a fragmentary plan view as indicated by the arrows 2—2 of FIG. 1.
Figure 3:
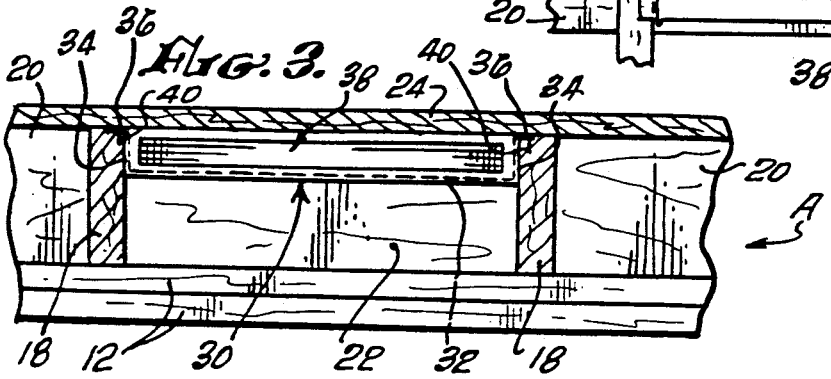
FIG. 3 is a fragmentary section as views along line 3—3 of FIG. 1.
Figure 4:
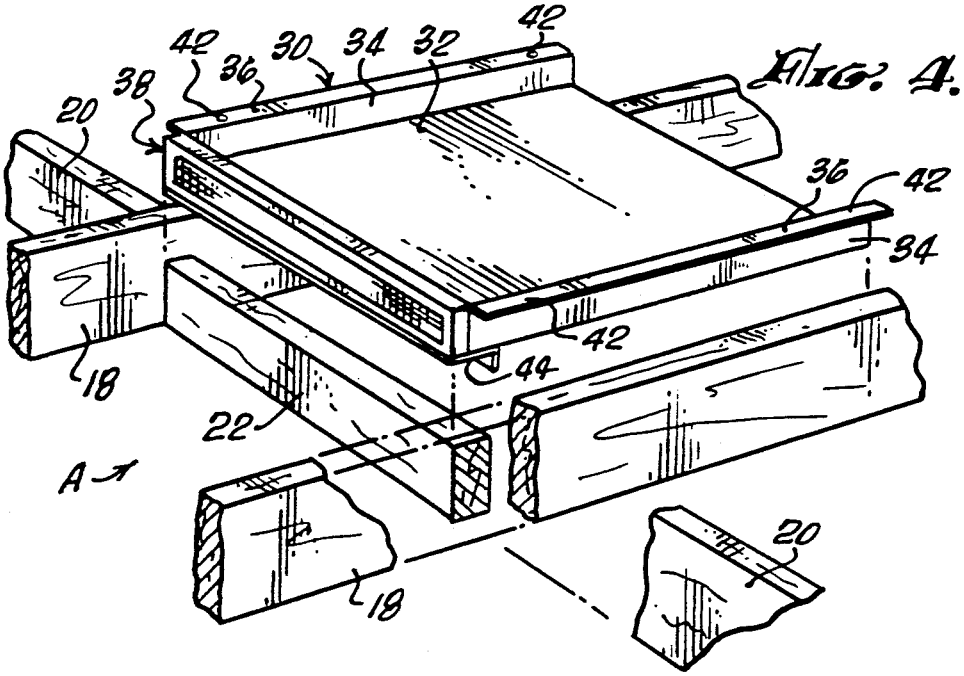
FIG. 4 is an exploded view of the vent apparatus of FIGS. 1, 2 and 3 and related structural members.

In the sectional view of FIG. 1, I have illustrated a typical construction of a building, specifically, the attic portion as indicated by the reference letter "A".

A pair of plates 12 are placed in conventional manner at the upper end of wall 11, as are truss members 14 which are also called ceiling joists in the industry. A ceiling 16, typically of wall board or plaster, comprises the lower confining area of the attic portion of the structure.

Rafters 18 are provided with blocking 20. Intermediate blocks 22 (wherever a vent unit is placed) keep the attic portion closed from the outside. Roof sheeting 24 completely covers the attic area.

The vent structure of the invention, as indicated by the reference numeral 30, is constructed of a single sheet of material such as galvanized iron, or the like. The vent has a central portion 32 large enough to span the distance between two rafters. Side walls 34 are formed on the vent 30 with sufficient height to form a channel for air passage into and out of the attic area. Tabs 36 are bent at right angles to the vertical side walls 34 and provide a shelf-like flange that is placed against the underside surface of roof sheeting 24. Fasteners such as nails, staples, screws, or the like 40, through holes 42 in these flanges secure the vent unit.

A screen member 38 is affixed to the end of the pan structure nearest the outside of the building by methods such as weldment, or the like. Also, vent opening may be formed by stamping or the like on solid metal.

It is seen that the pan member 30 can be secured easily into the ceiling area "A" at selected locations by construction personnel. With the minimum of labor the unit is ready for the rest of the building to be completed.

Insulating material 200, of a conventional type that is familiar to those versed in such art, can now be placed into the area above the ceiling and underneath the roof in such manner that it will not clog the vent or impair the passage of air.

In order to more easily locate the vent structure 30 into place, I have provided an angle 44 on the underside of the forward portion of the pan. This angle buts against the shortened blocking 22 and accurately locates the vent structure.

Figure 5:
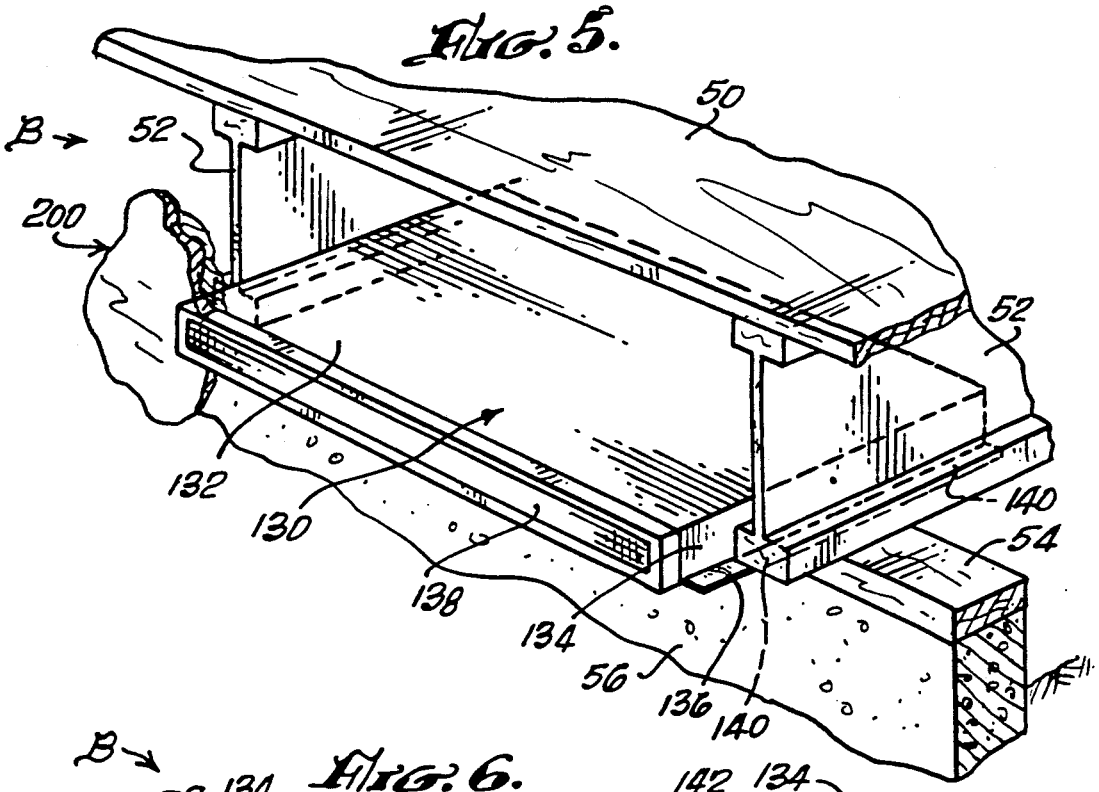
FIG. 5 is a fragmentary perspective view of the vent structure of FIGS. 1 through 4 inverted and installed as used in an underfloor location of a building.
Figure 6:
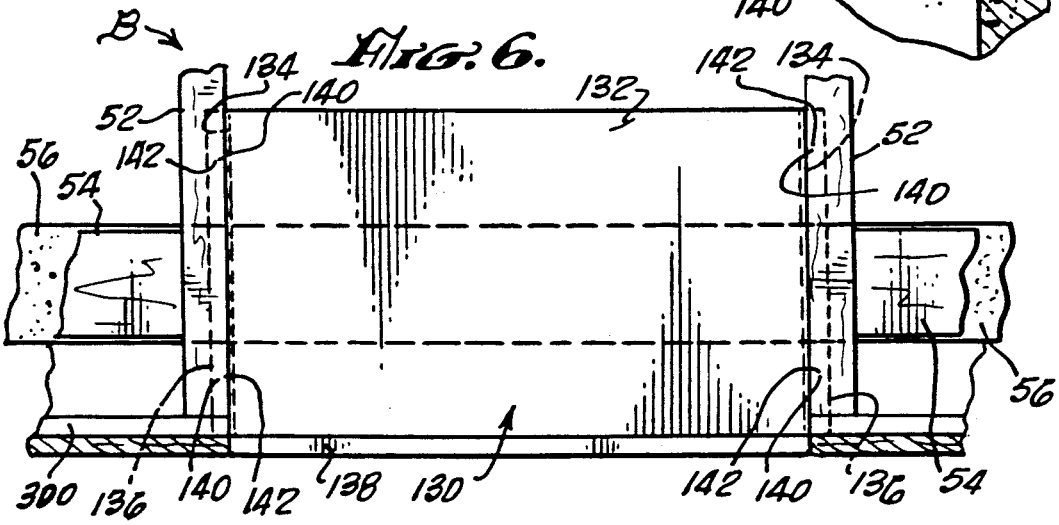
FIG. 6 is a fragmentary plan view of the device of FIG. 5.
Figure 7:
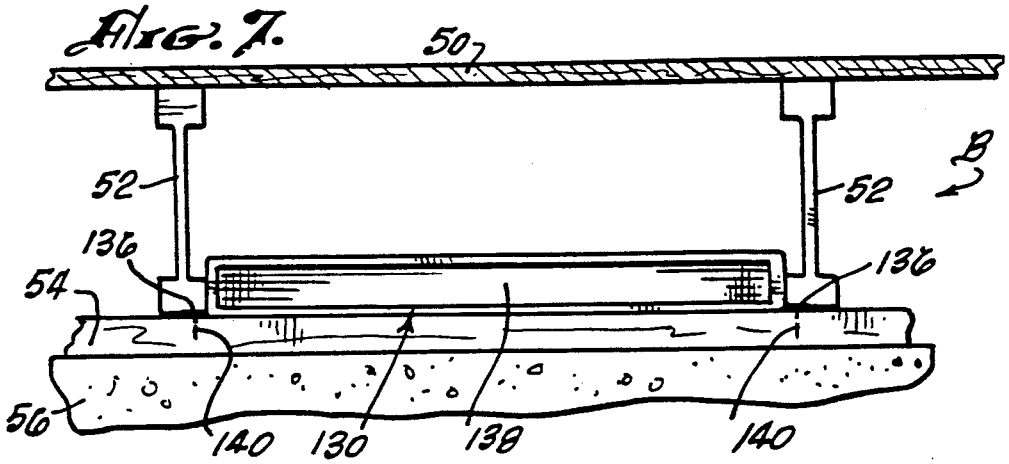
FIG. 7 is an end view of the device of FIGS. 5 and 6.

It can be seen that such a construction is readily applied to the lower portion of the structure as seen in the FIGS. 5 through 7 of this application.

In this showing, I have inverted the vent structure as previously described above to be placed onto the mudsill of a building foundation.

The pan, generally shown at 130, has a central panel 132, side walls 134, flanges 136 and a screen 138. Fasteners 140, in this instance, secure the pan to the mudsill 54 which is again secured and resting upon the foundation 56.

The overall subfloor area "B" comprises the subfloor 50 and spacer beams 52. Siding 300, with rim construction, forms a space for insulation to the outside walls.

The vent structure in this form allows a building to be constructed without having a variety of vent units prefabricated in different configurations. The invertability of this device allows utilization of identical vents both for attic vents and underfloor vents.

An alternate embodiment of the vent structure described above is illustrated in FIGS. 8 and 9 of the drawings.

Figure 8:
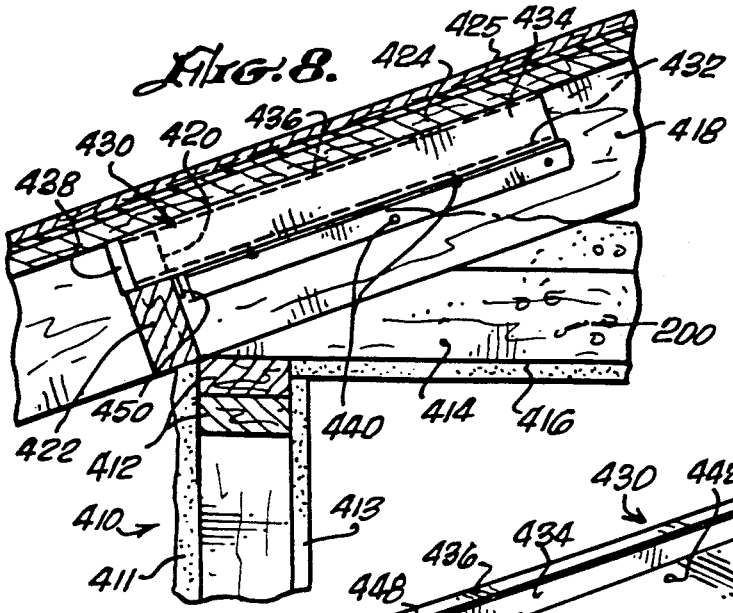
FIG. 8 is a sectional view similar to FIG. 1 showing an embodiment particularly applicable to renovation of existing buildings.

I have provided a vent unit 430 which is adaptable to be installed into an existing structure by removing a section of blocking to expose the inside of the attic structure between two rafters, or the like. The wall structure 410, in the illustration of FIG. 8 is seen to comprise outer and inner wall coverings 411 and 413, respectively, up to plate members 412.

Truss members, such as rafters 414, support the complete roof 425 and sub roof 424 along with ceiling 416. End blocking 420, already in the structure, is shown. Existing vents and blocking members are removed between said rafters at desired locations and are replaced with the construction and structural units herein described.

The alternate embodiment vent structure is shown at 430 as comprising a central panel 432 with side walls 434. Strengthening flanges are shown at 436 and screen portion 438 is affixed. Fasteners 440 can later by applied through holes 442.

To install the vent structure to the underside of the sub roof vicinity I provide a pair of angle irons 444 and secure them to the inside of the rafters as shown by using fastener through holes 446.

A pair of identical tabs 448 are shown punched out of the main panel 432 in order to provide stop members that abut against angle irons 444 during installation. A blocking member 422 is then placed in the exposed area between the rafters and the vent structure to close off unscreened access to the inside of the building.

Venting of the nature proposed by this invention can be easily installed into existing structures.

Figure 11:
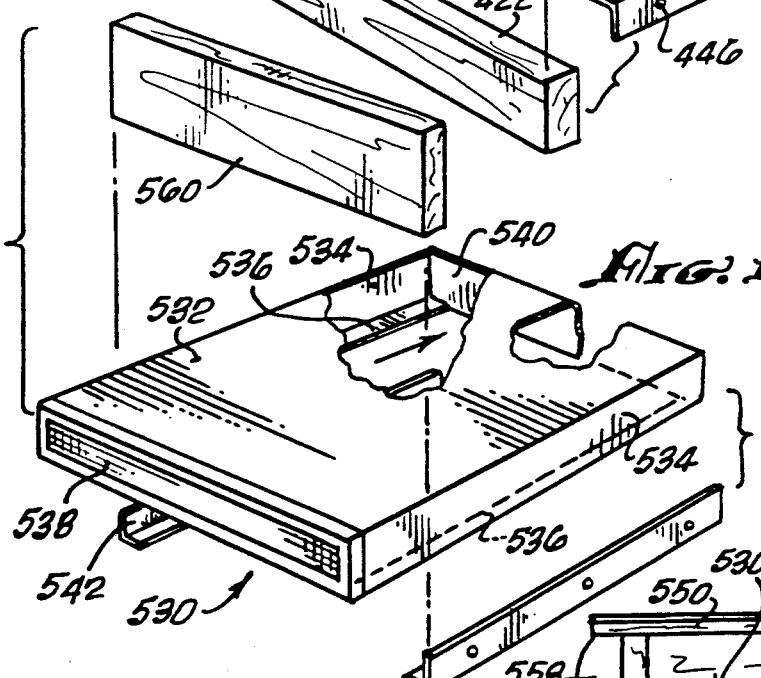
FIG. 11 is an exploded perspective of the device of FIG. 10 with portions broken away.
Figure 10:
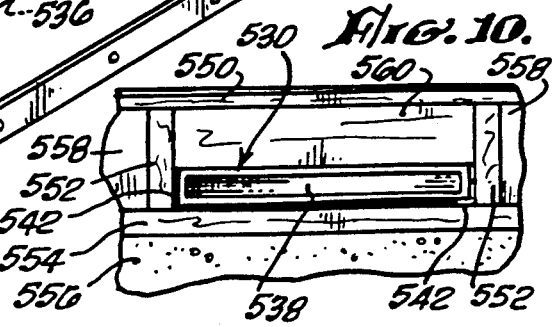
FIG. 10 is an end view of a lower portion of an existing building having been adapted to use the device of FIGS. 8 and 9.

In the illustrations of FIG. 10 and 11 the vent structure 530 is shown being installed into an area beneath the floor and above the foundation mudsill in an existing building.

Figure 9:
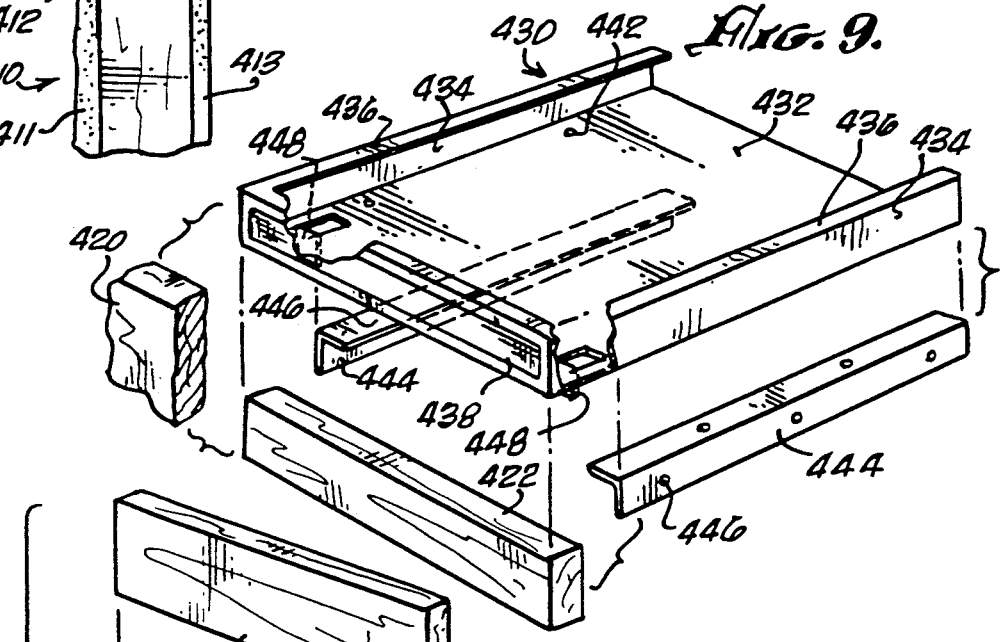
FIG. 9 is an exploded perspective of the alternate embodiment of FIG. 8 with certain portions broken away.

This particular embodiment is identical to the one installed into the existing structure as was shown in FIGS. 8 and 9 with the exception of the added extension 540. This downward extension of the central panel 532 is a baffle and aids in directing the flow of air from the outside of the building down toward the ground, thus keeping dust, and the like, from being blown about beneath the floor in an undesirable manner.

In this case, the vent unit is turned upside down and placed on angle irons 542 which are affixed to the insides of floor support members 552. A filler block 560 is placed in position to fill in the exposed area to the outside. Reference numbers are similar to like parts in the embodiment of FIGS. 8 and 9.

While the embodiments of this invention shown and described are fully capable of achieving the objects and advantages desired, it is to be understood that such embodiments are for purposes of illustration only and not for purposes of limitation.

I claim:

1. The method of providing venting and insulation under the roof of a building having walls, rafters, roof, and ceilings comprising: (1) fastening a trough having two ends, open at a first end and closed with vent means at a second end between two adjacent rafters and occupying a space approximately one half the height of the rafters; (2) providing a block completely closing any opening between the said trough and the top edge of the wall upon which the rafter rests; and (3) placing insulation directly against the block over the ceiling and under said trough preventing direct contact of the insulation to the exterior of the building.

2. The method of claim 1 wherein fastening of said trough is by means of flanges formed on said trough suitable to mount said trough on building structure elements.

3. The method of providing venting and insulation under the floor of a building comprising: (1) forming a trough having two sides, a bottom, and two open ends; (2) providing a vent in a first open end of said trough; (3) fastening said trough in an inverted position to building elements beneath the floor of a building with the vent end of the trough intercommunicating with the exterior of the building; (4) providing insulation beneath the floor and over the inverted bottom exterior of said trough.

4. The method of claim 3 wherein flanges suitable to mount said trough on building structure elements are provided adjacent the sides of said trough.

5. A vent to be used in building construction comprising a trough having a bottom having locating and mounting means attached thereto, two sides depending from the said bottom for a distance creating an essentially U shaped member with two ends, and a perforated member extending between the two sides and the bottom of said trough on one end thereon.

6. The device of claim 5 wherein each of said sides is provided with a flange depending at a 90 degree relationship from each side and in a direction outwardly from the trough for mounting said trough.

7. The device of claim 5 wherein a rib extending the width of said trough and depending outwardly from the bottom of said trough is fastened to said trough adjacent the end having the perforated member.

8. The device of claim 5 wherein at least one tab is provided adjacent the trough bottom extending in a direction parallel to the perforated member and in the opposite direction from the bottom of said trough.

9. The device of claim 5 wherein a baffle is provided at the open end of said trough to divert air flow therethrough.

* * * * *